US009696083B2

(12) United States Patent
Kim et al.

(10) Patent No.: US 9,696,083 B2
(45) Date of Patent: Jul. 4, 2017

(54) REFRIGERATOR

(71) Applicants: SAMSUNG ELECTRONICS CO., LTD., Suwon-si (KR); KOREA ADVANCED INSTITUTE OF SCIENCE AND TECHNOLOGY, Daejeon (KR)

(72) Inventors: Dae Whan Kim, Seoul (KR); Keon Kuk, Yongin-si (KR); Tae-Ho Song, Daejeon (KR); Sung-Kie Youn, Daejeon (KR); Kang Wonkyeong, Daejeon (KR); Pilseong Kang, Daejeon (KR); Yeo Inseok, Daejeon (KR); Jaehyug Lee, Daejeon (KR); Gil-Eon Jeong, Daejeon (KR); Choi Bongsu, Daejeon (KR)

(73) Assignees: SAMSUNG ELECTRONICS CO., LTD., Suwon-si (KR); KOREA ADVANCED INSTITUTE OF SCIENCE AND TECHNOLOGY, Daejeon (KR)

( * ) Notice: Subject to any disclaimer, the term of this patent is extended or adjusted under 35 U.S.C. 154(b) by 0 days.

(21) Appl. No.: 14/885,551

(22) Filed: Oct. 16, 2015

(65) Prior Publication Data

US 2016/0109172 A1 Apr. 21, 2016

(30) Foreign Application Priority Data

Oct. 16, 2014 (KR) ..... 10-2014-0139425

(51) Int. Cl.

| | |
|---|---|
| ***F25D 23/00*** | (2006.01) |
| ***F25D 23/06*** | (2006.01) |
| ***F25D 25/00*** | (2006.01) |

(52) U.S. Cl.

CPC ..... *F25D 23/065* (2013.01); *F25D 25/00* (2013.01); *F25D 2201/14* (2013.01)

(58) Field of Classification Search

CPC .... F25D 23/062; F25D 23/063; F25D 23/067; F25D 23/06; Y02B 80/12; B65D 81/3823

(Continued)

(56) References Cited

U.S. PATENT DOCUMENTS 1,574,569 A * 2/1926 Frazier ..... F25D 3/04 126/1 F
4,006,947 A * 2/1977 Haag ..... B65D 81/3823 220/592.1

(Continued)

FOREIGN PATENT DOCUMENTS

DE 2757233 * 7/1979
EP 2778583 A2 9/2014

(Continued)

OTHER PUBLICATIONS

JP 2015168465; figure and absract Sep. 2015.*

(Continued)

*Primary Examiner* — Janet M Wilkens
(74) *Attorney, Agent, or Firm* — Staas & Halsey LLP

(57) ABSTRACT

Disclosed herein is a refrigerator which has an improved structure to increase insulating properties. The refrigerator includes a body including an inner casing and an outer casing, a storage compartment formed in the inner casing, an insulator provided between the inner casing and the outer casing to insulate the storage compartment, and a frame unit which is disposed between the adjacent insulators to ensure stiffness of the body and includes at least one coupling surface coupled with at least one of the inner casing and the outer casing.

19 Claims, 13 Drawing Sheets

(58) Field of Classification Search
USPC ..... 312/401, 400, 406, 405
See application file for complete search history.

(56) References Cited

U.S. PATENT DOCUMENTS

| | | | | |
|---|---|---|---|---|
| 4,043,624 | A * | 8/1977 | Lindenschmidt | F25D 23/062 220/592.05 |
| 5,175,975 | A * | 1/1993 | Benson | A47J 27/002 428/172 |
| 5,605,047 | A * | 2/1997 | Park | F25B 21/02 62/3.6 |
| 5,632,543 | A * | 5/1997 | McGrath | F25D 23/063 220/592.09 |
| 5,857,307 | A | 1/1999 | Takemasa et al. | |
| 2006/0097608 | A1* | 5/2006 | Dugand | A47B 47/0008 312/236 |
| 2009/0145050 | A1* | 6/2009 | Dugand | A47B 47/0041 52/36.1 |
| 2010/0287974 | A1* | 11/2010 | Cur | F25D 23/063 62/449 |
| 2012/0297813 | A1* | 11/2012 | Hanley | F25D 23/064 62/331 |
| 2013/0257256 | A1 | 10/2013 | Allard et al. | |

FOREIGN PATENT DOCUMENTS

| | | |
|---|---|---|
| GB | 2493273 A | 1/2013 |
| JP | 2011-241988 | 12/2011 |

OTHER PUBLICATIONS

Extended European Search Report dated Feb. 16, 2016 in corresponding European Patent Application No. 15189873.1, 9 pages.

* cited by examiner

REFRIGERATOR

CROSS-REFERENCE TO RELATED APPLICATION

This application claims the benefit of Korean Patent Application No. 10-2014-0139425, filed on Oct. 16, 2014 in the Korean Intellectual Property Office, the disclosure of which is incorporated herein by reference.

BACKGROUND

1. Field

Embodiments of the present invention relate to a refrigerator, and more particularly, to a refrigerator having an improved structure to increase an insulating effect.

2. Description of the Related Art

Generally, refrigerators are a home appliance which includes a body, a storage compartment formed inside the body, and a cool air supply device for supplying cool air to the storage compartment and keeps food fresh.

A body of a refrigerator includes an inner casing which forms a storage compartment, an outer casing provided outside the inner casing to form an exterior, and an insulator provided between the inner casing and the outer casing to insulate the storage compartment. Generally, urethane foam is used for the insulator.

Since urethane foam insulators provide full stiffness after foaming and fix an inner casing and an outer casing through their own adhesive force, most refrigerators use urethane foam insulators.

However, recently, to improve insulating properties, vacuum insulators consisting of a covering material with a core material provided in the covering material and vacuum sealed therein is used. However, even when using vacuum insulators, since urethane foam insulators and vacuum insulators are used together to maintain stiffness and assembling properties, there is a limit to improve insulating properties.

SUMMARY

Therefore, it is an aspect of the present invention to provide a refrigerator having an improved structure to protect an insulator and to ensure a structural stiffness of a body.

It is another aspect of the present invention to provide a refrigerator having an improved structure to increase a storage capacity of a storage compartment.

It is still another aspect of the present invention to provide a refrigerator having an improved structure to improve insulating properties.

It is yet another aspect of the present invention to provide a refrigerator having an improved structure to facilitate installation of an insulator in a body.

It is yet another aspect of the present invention to provide a refrigerator having a body formed of only a vacuum insulator.

Additional aspects of the invention will be set forth in part in the description which follows and, in part, will be obvious from the description, or may be learned by practice of the invention.

In accordance with one aspect of the present invention, a refrigerator includes a body including an inner casing and an outer casing, a storage compartment formed in the inner casing, an insulator provided between the inner casing and the outer casing to insulate the storage compartment, and a frame unit which is disposed between adjacent insulators to ensure stiffness of the body and includes at least one coupling surface coupled with at least one of the inner casing and the outer casing.

The frame unit may include a first frame unit which faces a first direction and a second frame which faces a second direction, both of which are arranged in a grid shape, and may include a supporting frame which includes an installation space in which the insulator is installed and is mounted between the first frame and the second frame.

The at least one coupling surface may be coupled with the supporting frame to form the installation space.

The at least one coupling surface may include a first coupling surface coupled with the supporting frame to face an inner wall of the outer casing and a second coupling surface coupled with the supporting frame to face an outer wall of the inner casing.

The first coupling surface and the second coupling surface may be alternately arranged in at least one of the first direction and the second direction.

The first coupling surface may be located between the insulator and the outer casing, and the second coupling surface may be located between the insulator and the inner casing.

The at least one coupling surface may be fixed to at least one of the inner casing and the outer casing by an adhesive member.

The supporting frame may be disposed between the inner casing and the outer casing to be vertical to at least one of the inner casing and the outer casing.

The frame unit may further include a case which surrounds the insulator and the supporting frame.

The at least one coupling surface may include a first coupling surface formed on one surface of the case to face an inner wall of the outer casing and a second coupling surface formed on another surface of the case to face an outer wall of the inner casing.

In accordance with another aspect of the present invention, a refrigerator includes a body including an inner casing and an outer casing, a storage compartment formed in the inner casing, a vacuum insulator provided between the inner casing and the outer casing to insulate the storage compartment, and a supporting frame which is provided between the inner casing and the outer casing and includes an installation space in which the vacuum insulator is installed. Herein, the installation space includes at least one side which is open to allow the vacuum insulator to face at least one of the inner casing and the outer casing.

The supporting frame may include at least one first frame which is elongated in a first direction and at least one second frame which is elongated in a second direction to form an intersection point with the at least one first frame.

The at least one first frame and the at least one second frame may intersect each other at a right angle.

The supporting frame may further include at least one coupling surface coupled with the at least one first frame and the at least one second frame to form the installation space.

The at least one coupling surface may be irregularly arranged in at least one of the first direction and the second direction.

The open side of the installation space may be surrounded by the at least one coupling surface.

The at least one coupling surface may include a first coupling surface located between the vacuum insulator and the outer casing and a second coupling surface located between the vacuum insulator and the inner casing.

The first coupling surface and the second coupling surface may be alternately arranged in at least one of the first direction and the second direction.

The installation space may include a first installation space which has one surface open toward the first coupling surface and an outer wall of the inner casing and a second installation space which has one surface open toward the second coupling surface and an inner wall of the outer casing.

The first installation space and the second installation space may be alternately arranged in at least one of the first direction and the second direction.

The at least one first frame, the at least one second frame, and the at least one coupling surface may be integrally formed.

The supporting frame may be coupled with the body by fixing the at least one coupling surface to at least one of the inner casing and the outer casing using an adhesive member.

The supporting frame may be inserted into and coupled with at least one of the inner casing and the outer casing.

In accordance with still another aspect of the present invention, a refrigerator includes a body including an inner casing and an outer casing, a storage compartment formed in the inner casing, a vacuum insulator provided between the inner casing and the outer casing to insulate the storage compartment, and a reinforcing member which is provided between the inner casing and the outer casing to ensure stiffness of the body and includes an installation space in which the vacuum insulator is installed. Herein, the reinforcing member is directly coupled with the inner casing and the outer casing.

The reinforcing member may include a first frame which faces a first direction, a second frame which faces a second direction, and a third frame which faces a third direction. The first frame, the second frame, and the third frame may be coupled with one another to surround to the inner casing.

Any one of the first frame, the second frame, and the third frame may be vertical to another one of the first frame, the second frame, and the third frame.

The reinforcing member may be inserted into and coupled with the inner casing and the outer casing.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
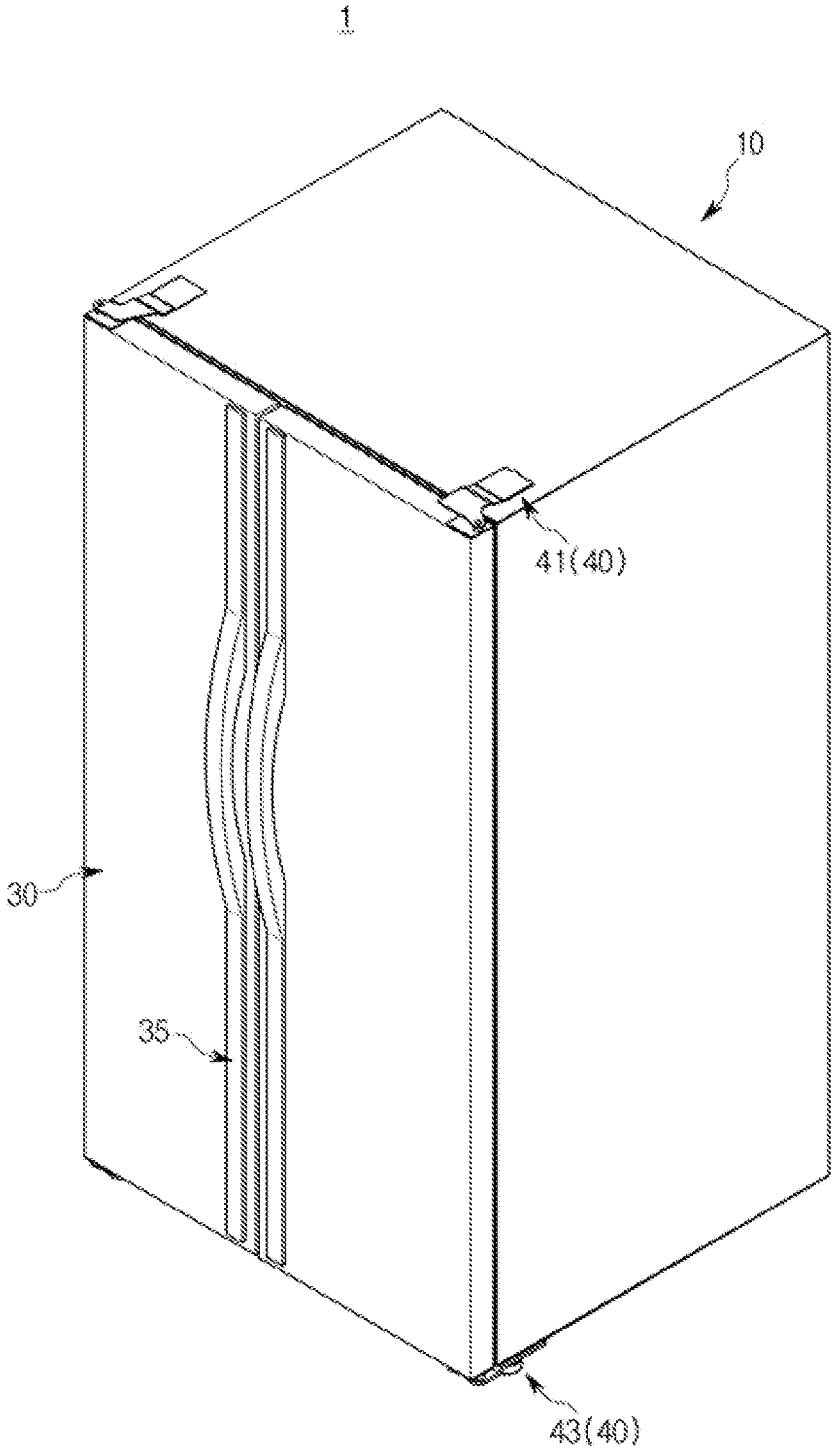
FIG. 1 is a perspective view illustrating an exterior of a refrigerator in accordance with one embodiment of the present invention.

Reference will now be made in detail to the embodiments of the present invention, examples of which are illustrated in the accompanying drawings, wherein like reference numerals refer to like elements throughout.

Hereinafter, exemplary embodiments of the present invention will be described in detail with reference to the attached drawings. Terms used herein "a front end", "a rear end", "a top", "a bottom", "a top end", and "a bottom end" are defined based on the drawings. However, shapes and positions of respective components will not be limited thereto.

Figure 2:
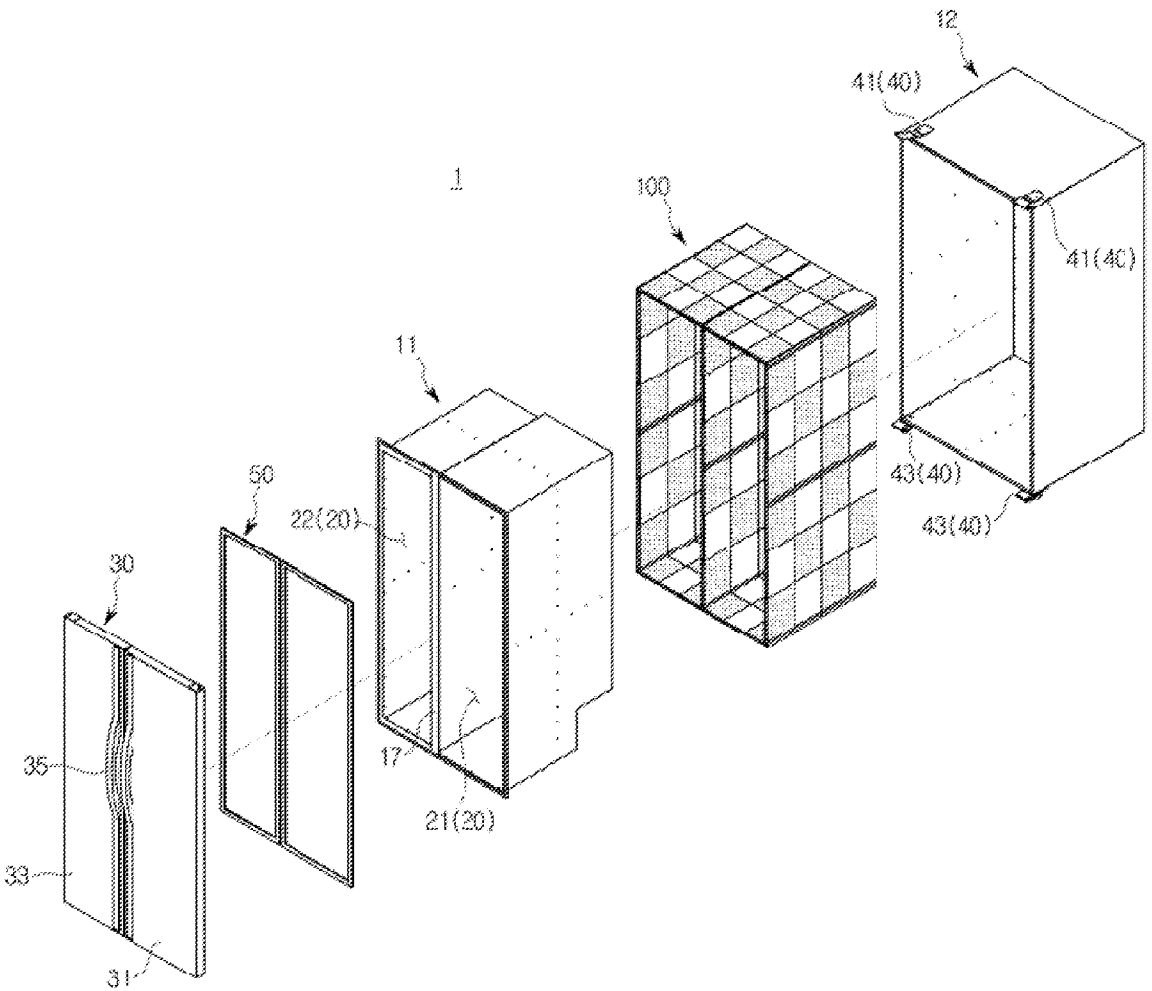
FIG. 2 is an exploded perspective view of the refrigerator in accordance with one embodiment of the present invention.

FIG. 1 is a perspective view illustrating an exterior of a refrigerator 1 in accordance with one embodiment of the present invention. FIG. 2 is an exploded perspective view of the refrigerator 1 in accordance with one embodiment of the present invention. Hereinafter, an insulating unit 100 may be used as a means which includes an insulating unit module.

As shown in FIGS. 1 and 2, the refrigerator 1 may further include a body 10 which includes a storage compartment 20 therein.

The body 10 may have an approximate box shape. The body 10 may include an inner casing 11 and an outer casing 12 provided outside the inner casing 11. In detail, the storage compartment 20 may be formed in the inner casing 11. Also, the exterior of the refrigerator 1 may be determined by a shape of the outer casing 12. The outer casing 12 and the inner casing 11 may be formed of mutually different materials. For example, the outer casing 12 may be formed of a metal material in consideration of durability. Also, the inner casing 11 may be formed of a resin material in consideration of insulating properties and convenience of manufacturing. Preferably, the outer casing 12 may be formed of steel and the inner casing 11 may be formed of an Acrylonitrile-Butadiene-Styrene (ABS) copolymer. However, the materials of the outer casing 12 and the inner casing 11 are not limited thereto.

A front side of the storage compartment 20 may be opened to insert or withdraw food. The storage compartment 20 may be partitioned into left and right compartments by a partition wall 17. A refrigerating compartment 21 may be provided in the right compartment of the body 10, and a freezing compartment 22 may be provided in the left compartment of the body 10. However, positions of the refrigerating compartment 21 and the freezing compartment 22 are not limited thereto but are variously changeable.

A plurality of shelves (not shown) may be provided in the storage compartment 20 to partition the storage compartment 20 and items such as food may be loaded on top of the shelves. Also, a plurality of storage boxes (not shown) may be provided in the storage compartment 20 to be slidably inserted or withdrawn.

The body 10 may further include a cool air supply device which supplies cool air to the storage compartment 20. The cool air supply device may include a compressor (not shown), a condenser (not shown), an expansion valve (not shown), an evaporator (not shown), a blowing fan (not shown), etc.

The refrigerator 1 may further include a door 30. The door 30 may be provided to open and close the open front side of the storage compartment 20. The refrigerating compartment 21 and the freezing compartment 22 may be opened and closed by a refrigerating compartment door 31 and a freezing compartment door 33 pivotably coupled with the body 10, respectively. A plurality of door guards (not shown) may be provided on rear surfaces of the refrigerating compartment door 31 and the freezing compartment door 33.

The door 30 may include a handle 35 to facilitate a user's grip.

The refrigerator 1 may further include a hinge module 40 to allow the door 30 to be pivotably coupled with the body 10. The hinge module 40 may include an upper hinge 41 and a lower hinge 43.

The refrigerator 1 may further include an insulator 110 provided between the inner casing 11 and the outer casing 12 to insulate the storage compartment 20.

In other words, an insulating unit 100 may be provided between the inner casing 11 and the outer casing 12 of the body 10 to prevent leakage of cool air in the storage compartment 20.

The insulating unit 100 may include a plurality of insulating unit modules. In other words, the insulating unit 100 may be formed by coupling the plurality of insulating unit modules to each other. Hereinafter, a single insulating unit module will be described.

Figure 3:
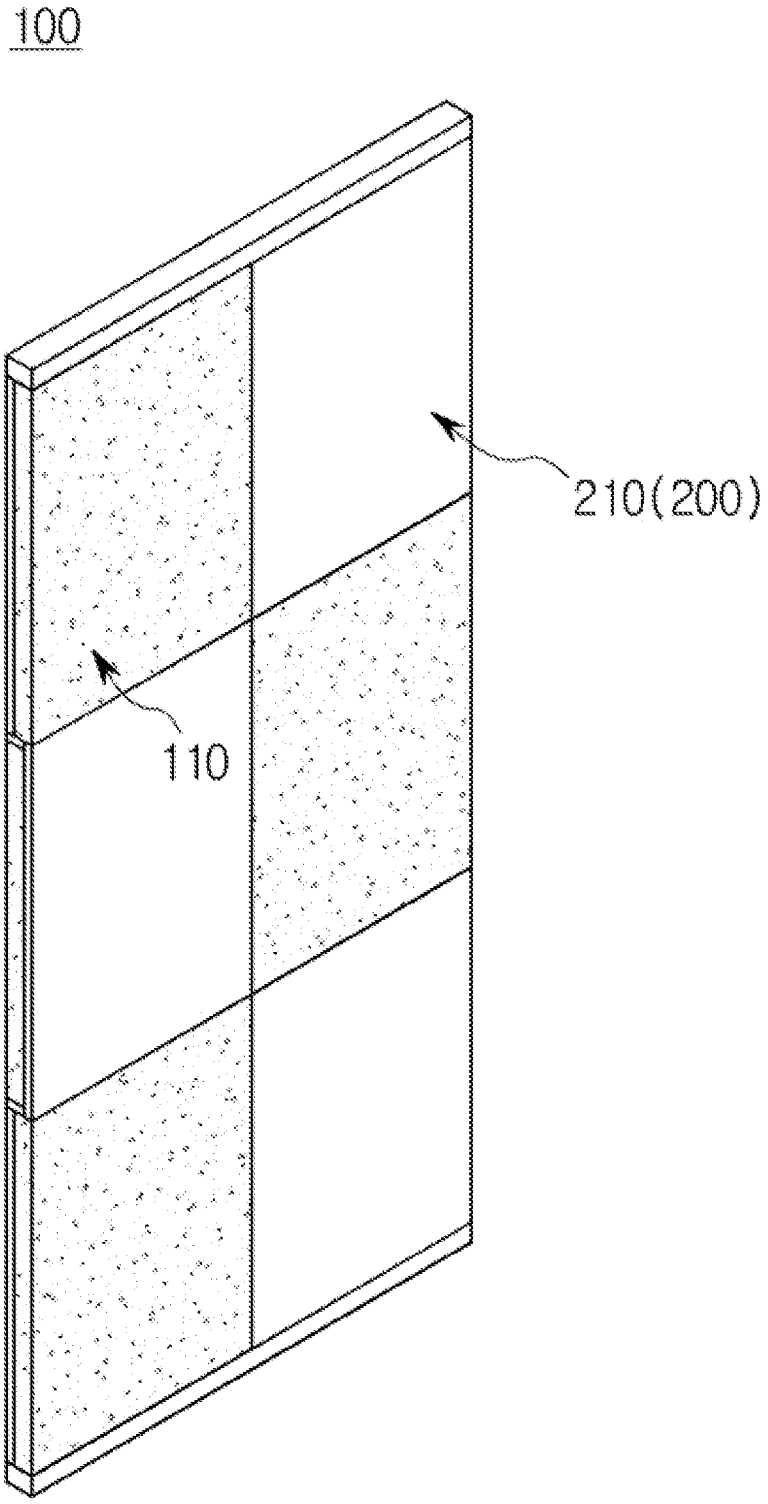
FIG. 3 is an enlarged view of an insulating unit in accordance with a first embodiment disposed between an inner casing and an outer casing in the refrigerator in accordance with one embodiment of the present invention.
Figure 6:
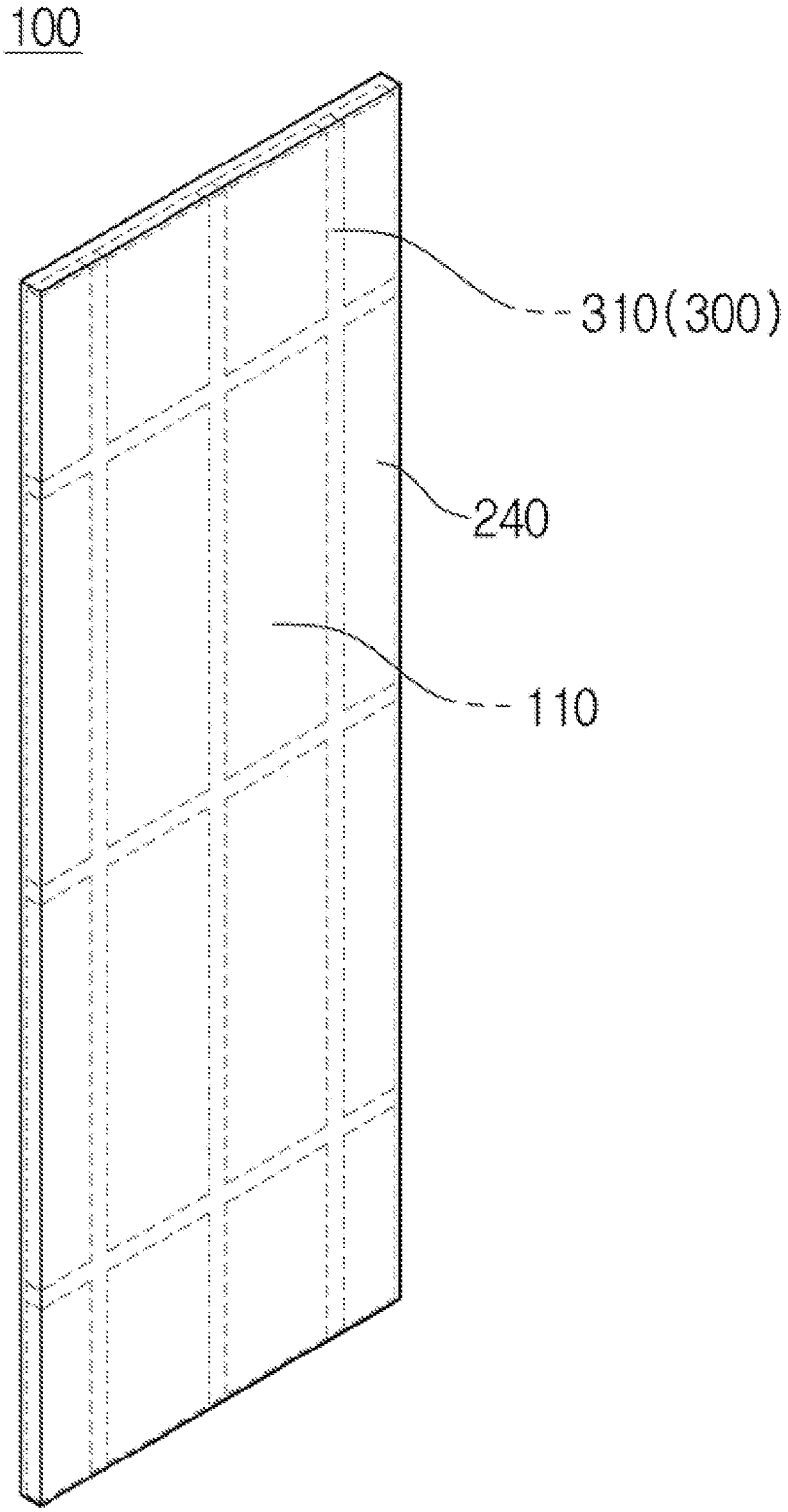
FIG. 6 is a view of an insulating unit in accordance with a second embodiment disposed between the inner casing and the outer casing in the refrigerator in accordance with one embodiment of the present invention.

The insulating unit 100 may include the insulator 110 (refer to FIG. 3) and frame units 200 and 300 (refer to FIGS. 3 and 6).

The insulator 110 may include a vacuum insulation panel (VIP). The VIP may include a core material and a covering material. The core material may be provided in the covering material. The covering material may seal the core material to maintain the core material in a vacuum state. The core material may be formed of fumed silica or glass fiber having excellent durability and low thermal conductivity, but is not limited thereto. The covering material may be formed of a deposition in which aluminum foil or metal having low gas and moisture permeability and an inorganic material are deposited, but is not limited thereto. The VIP may further include a getter provided to maintain a vacuum state inside the covering material for a long time by adsorbing gas and moisture inside the covering material. The getter may be calcium oxide (CaO), but is not limited thereto.

The frame units 200 and 300 may be provided between the inner casing 11 and the outer casing 12 to ensure stiffness of the body 10. That is, the frame units 200 and 300 may prevent displacement or deformation of the inner casing 11 and the outer casing 12 by reinforcing the strength of the inner casing 11 and the outer casing 12. Also, the frame units 200 and 300 may be provided between the inner casing 11 and the outer casing 12 to support the insulator 110.

The frame units 200 and 300 may be formed of a material having excellent durability and a small heat transfer coefficient. In detail, the frame unit 300 may include at least one material of steel and stainless steel (SUS). Otherwise, the frame units 200 and 300 may include at least one material of polycarbonate (PC), polystyrene (PS), and polyphenylene sulfide (PPS). In other words, the frame units 200 and 300 may include at least one material of metal and plastic.

The insulator 110 may be installed in at least one of the inner casing 11 and the outer casing 12 of the body 10 to avoid direct bonding or coupling thereto. Accordingly, the insulator 110 of which life has ended or which is damaged can easily be replaced.

A detailed description of the frame units 200 and 300 will be given below.

The insulating unit 100 may be provided inside the partition wall 17 which partitions the storage compartment 20 into the refrigerating compartment 21 and the freezing compartment 22. In other words, the insulating unit 100 may be provided between the inner casing 11 forming the partition wall 17.

The insulating unit 100 may be provided inside the door 30.

The refrigerator 1 may further include a sealing member 50.

The sealing member 50 may be provided between the door 30 and the body 10 to prevent outward leakage of the cool air in the storage compartment 20.

The sealing member 50 may have an elastic material having an excellent adhesive force. For example, the sealing member 50 may have rubber.

Figure 4:
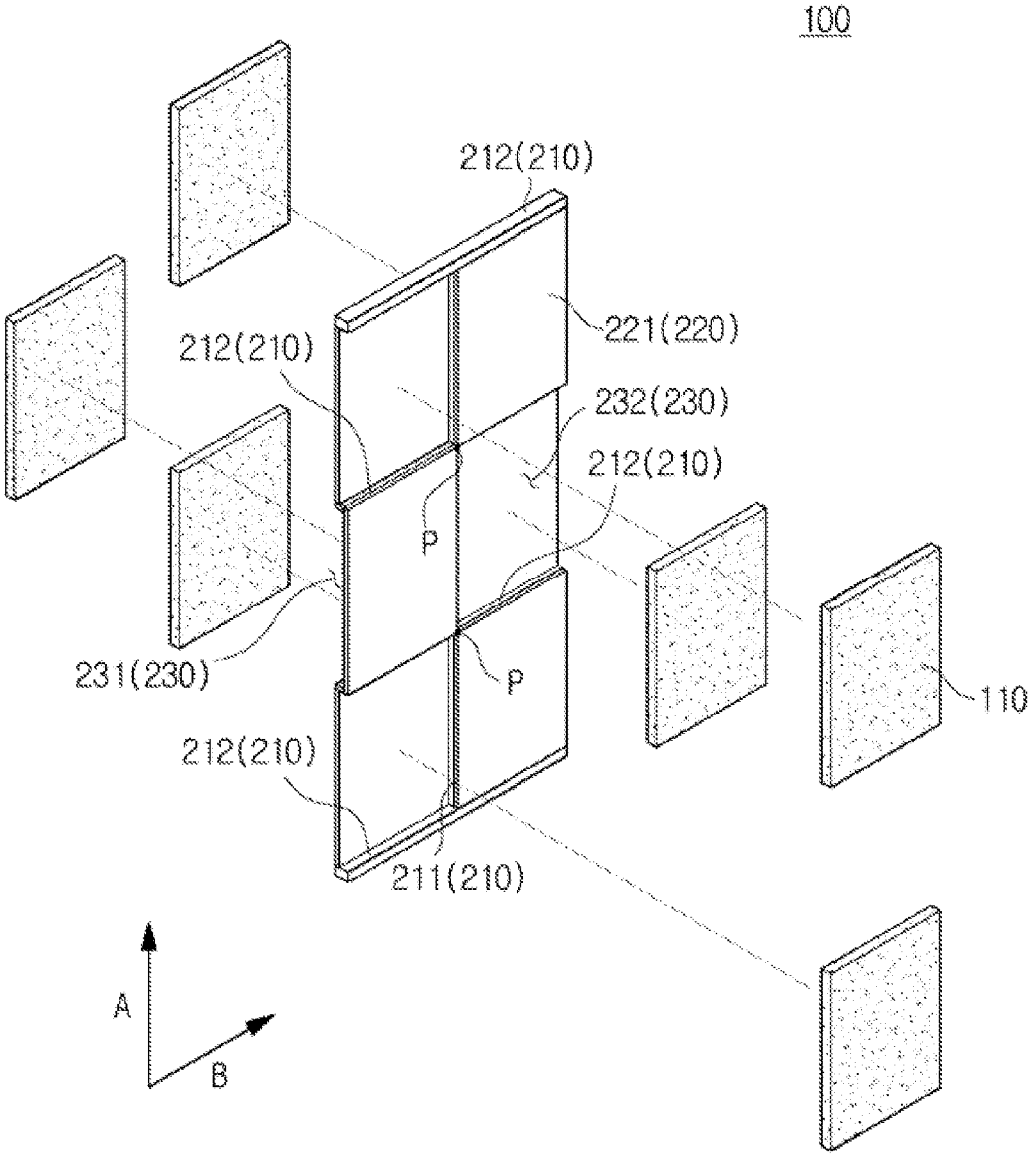
FIG. 4 is an exploded perspective view of the insulating unit in accordance with the first embodiment in the refrigerator in accordance with one embodiment of the present invention.
Figure 5:
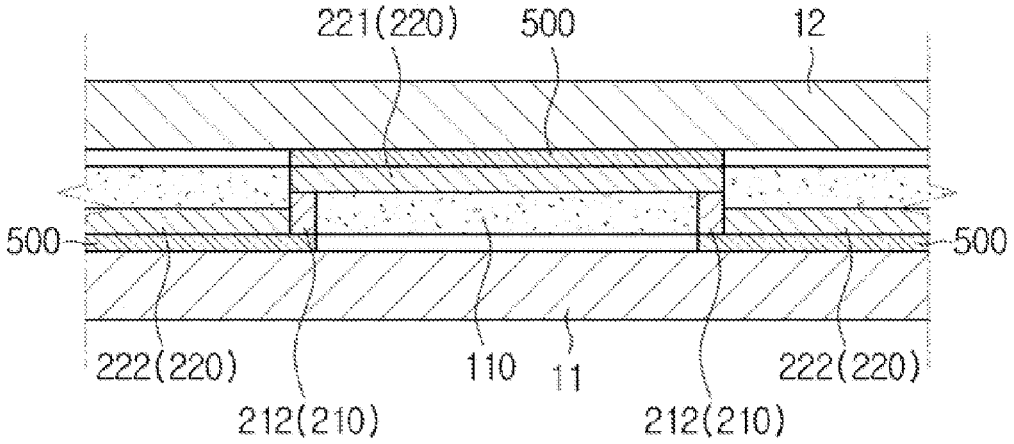
FIG. 5 is a cross-sectional view of the insulating unit in accordance with the first embodiment in the refrigerator in accordance with one embodiment of the present invention.

FIG. 3 is an enlarged view of the insulating unit 100 in accordance with a first embodiment disposed between the inner casing 11 and the outer casing 12 in the refrigerator 1 in accordance with one embodiment of the present invention. FIG. 4 is an exploded perspective view of the insulating unit 100 in accordance with the first embodiment in the refrigerator 1 in accordance with one embodiment of the present invention. FIG. 5 is a cross-sectional view of the insulating unit 100 in accordance with the first embodiment in the refrigerator 1 in accordance with one embodiment of the present invention. Hereinafter, FIGS. 1 and 2 should be referred to while describing reference numerals not shown in the drawings. Also, a repetitive description of FIGS. 1 and 2 will be omitted.

As shown in FIGS. 3 to 5, the insulating unit 100 may include the insulator 110 and the frame unit 200.

The frame unit 200 may be provided between adjacent insulators 110 to ensure stiffness of the body 10. Also, the frame unit 200 may have at least one coupling surface 220 coupled with at least one of the inner casing 11 and the outer casing 12.

The frame unit 200 may include a supporting frame 210.

The supporting frame 210 may include a first frame 211 which faces a first direction A and a second frame 212 which faces a second direction B. The first frame 211 and the second frame 212 may be arranged to form an intersection point P. In detail, the first frame 211 and the second frame 212 may be arranged in a grid shape. That is, the supporting frame 210 may have a grid structure.

The supporting frame 210 may be disposed between the inner casing 11 and the outer casing 12 to be vertical to at least one of the inner casing 11 and the outer casing 12.

The supporting frame 210 may include an installation space 230 in which the insulator 110 is installed. In detail, the installation space 230 in which the insulator 110 is installed may be formed between the first frame 211 and the second frame 212. In other words, the supporting frame 210 may partition the installation space 230 in which the insulator 110 is installed.

The at least one coupling surface 220 may be coupled with the supporting frame 210 to form the installation space 230.

The at least one coupling surface 220 may include a first coupling surface 221 and a second coupling surface 222.

The first coupling surface 221 may be coupled with the supporting frame 210 to face an inner wall of the outer casing 12. The second coupling surface 222 may be coupled with the supporting frame 210 to face an outer wall of the inner casing 11. To describe another aspect, the first coupling surface 221 may be located between the insulator 110 and the outer casing 12 and the second coupling surface 222 may be located between the insulator 110 and the inner casing 11.

The first coupling surface 221 and the second coupling surface 222 may be alternately arranged in at least one of the first direction A and the second direction B.

Describing another aspect of the supporting frame 210, the installation space 230 in which the insulator 110 is installed may be formed inside the supporting frame 210. The installation space 230 may have at least one side which is open to allow the insulator 110 installed in the installation space 230 to face at least one of the inner casing 11 and the outer casing 12. Preferably, the installation space 230 may have one side which is open to allow the insulator 110 installed in the installation space 230 to face the inner casing 11 or the outer casing 12.

The supporting frame 210 may include at least one first frame 211 and at least one second frame 212. The at least one first frame 211 may be elongated in the first direction A. The at least one second frame 212 may be elongated in the second direction B to form the intersection point P together with the at least one first frame 211.

The at least one first frame 211 and the at least one second frame 212 may intersect each other. For example, the at least one first frame 211 and the at least one second frame 212 may intersect each other at a right angle.

The supporting frame 210 may further include at least one coupling surface 220. The at least one coupling surface 220 may be coupled with the at least one first frame 211 and the at least one second frame 212 to form the installation space 230.

The at least one coupling surface 220 may be discontinuously arranged in at least one of the first direction A and the second direction B. In detail, when the installation space 230 has one open side which faces the inner wall of the outer casing 12, the one side of the installation space 230, which is open toward the inner wall of the outer casing 12 and the first coupling surface 221 may be alternately arranged in at least one of the first direction A and the second direction B. Also, when the installation space 230 has one open side which faces the outer wall of the inner casing 11, the one side of the installation space 230, which is open toward the outer wall of the inner casing 11 and the second coupling surface 222 may be alternately arranged in at least one of the first direction A and the second direction B.

The open side of the installation space 230 may be surrounded by at least one coupling surface 220. In detail, the installation space 230 which has the one side open toward the inner wall of the outer casing 12 may be surrounded by the first coupling surface 221. Also, the installation space 230 which has the one side open toward the outer wall of the inner casing 11 may be surrounded by the second coupling surface 222.

The first coupling surface 221 and the second coupling surface 222 may be alternately arranged in at least one of the first direction A and the second direction B. Accordingly, a first installation space 231 and a second installation space 232 which will be described below may be alternately arranged.

The installation space 230 may include the first installation space 231 and the second installation space 232.

The first installation space 231 may have one side open toward the first coupling surface 221 and the outer wall of the inner casing 11. The second installation space 232 may have one side open toward the second coupling surface 222 and the inner wall of the outer casing 12.

The first installation space 231 and the second installation space 232 may be alternately arranged in at least one of the first direction A and the second direction B.

The supporting frame 210 may be integrally formed. In detail, the at least one first frame 211, the at least one second frame 212, and the at least one coupling surface 220 may be integrally formed.

Otherwise, the supporting frame 210 may be formed by an assembling or a coupling of the at least one first frame 211, the at least one second frame 212, and the at least one coupling surface 220.

The supporting frame 210 may be inserted into and coupled with at least one of the inner casing 11 and the outer casing 12. For example, the supporting frame 210 may include a plurality of protrusions (not shown) which protrude toward at least one of the inner casing 11 and the outer casing 12. The at least one of the inner casing 11 and the outer casing 12 may include a plurality of fixing grooves (not shown) to which the plurality of protrusions formed on the supporting frame 210 are able to be inserted and coupled. Preferably, the plurality of protrusions may be formed on the at least one coupling surface 220 which faces the at least one of the inner casing 11 and the outer casing 12. The supporting frame 210 may be coupled with the at least one of the inner casing 11 and the outer casing 12 by coupling between the plurality of protrusions and the plurality of fixing grooves.

The supporting frame 210 may be fixed to the at least one of the inner casing 11 and the outer casing 12 by an adhesive member 500. Preferably, the at least one coupling surface 220 may be fixed to the at least one of the inner casing 11 and the outer casing 12 by the adhesive member 500. To conclude, the at least one coupling surface 220 may be fixed to the at least one of the inner casing 11 and the outer casing 12 by the adhesive member 500, thereby coupling the supporting frame 210 with the body 10.

Members having an adhesive force may be commonly called the adhesive member 500. The adhesive member 500 may include a double-sided tape, but is not limited thereto.

Figure 7:
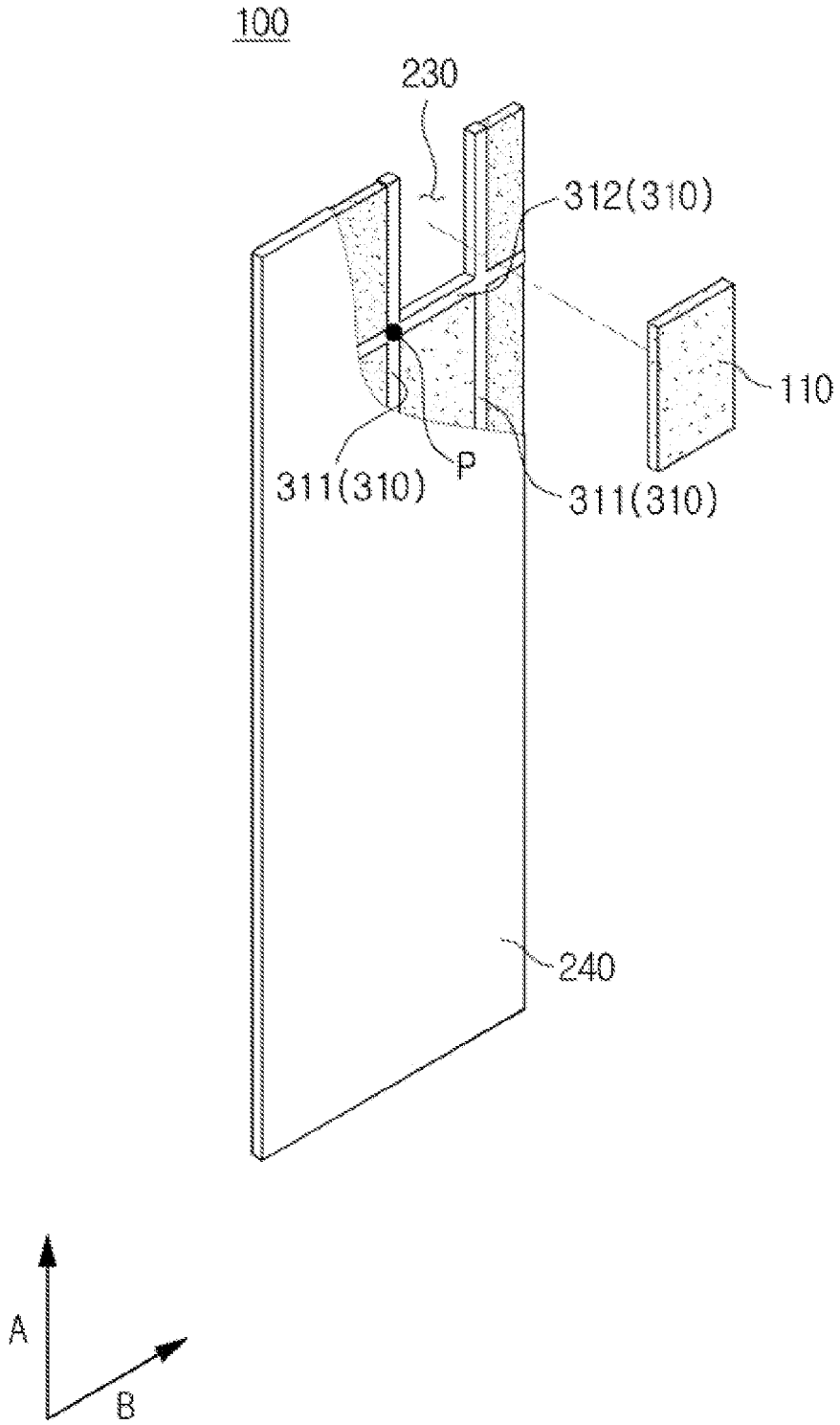
FIG. 7 is an exploded perspective view illustrating the insulating unit in accordance with the second embodiment from which a part is taken in the refrigerator in accordance with one embodiment of the present invention.
Figure 8:
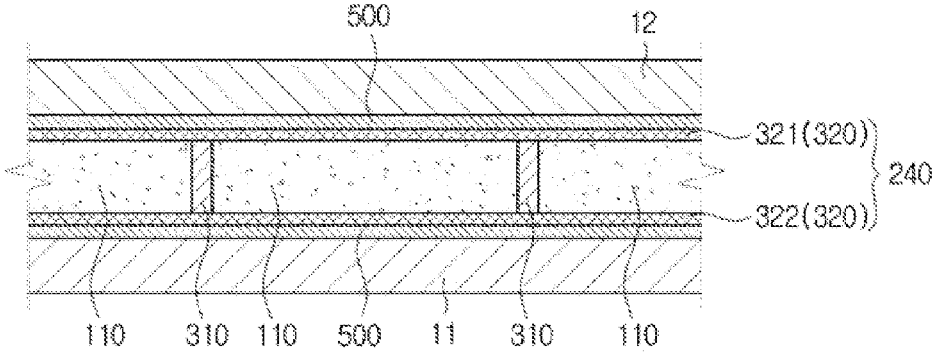
FIG. 8 is a cross-sectional view of the insulating unit in accordance with the second embodiment in the refrigerator in accordance with one embodiment of the present invention.

FIG. 6 is a view illustrating the insulating unit 100 in accordance with a second embodiment disposed between the inner casing 11 and the outer casing 12 in the refrigerator 1 in accordance with one embodiment of the present invention. FIG. 7 is an exploded perspective view illustrating the insulating unit 100 in accordance with the second embodiment from which a part is taken in the refrigerator 1 in accordance with one embodiment of the present invention. FIG. 8 is a cross-sectional view of the insulating unit 100 in accordance with the second embodiment in the refrigerator 1 in accordance with one embodiment of the present invention. Hereinafter, FIGS. 1 and 2 should be referred to while describing reference numerals not shown in the drawings.

As shown in FIGS. 6 to 8, the insulating unit 100 may include the insulator 110 and the frame unit 300.

The insulator 110 may be provided inside the frame unit 300. In other words, the frame unit 300 may surround the insulator 110.

The frame unit 300 may include a supporting frame 310.

The supporting frame 310 may include a first frame 311 which faces a first direction A and a second frame 312 which faces a second direction B. The first frame 311 and the second frame 312 may be arranged to form an intersection point P. In detail, the first frame 311 and the second frame 312 may be arranged in a grid shape. That is, the supporting frame 310 may have a grid structure.

The supporting frame 310 may include the installation space 230 in which the insulator 110 is installed. In detail, the installation space 230 in which the insulator 110 is installed may be formed between the first frame 311 and the second frame 312. In other words, the supporting frame 310 may partition the installation space 230 in which the insulator 110 is installed.

The frame unit 300 may further include a case 240.

The case 240 may surround the insulator 110 and the supporting frame 310. In other words, the insulator 110 and the supporting frame 310 may be built in the case 240. The case 240 may have a hexahedral box shape, but is not limited thereto.

The supporting frame 310 and the case 240 may be formed of the same material. The supporting frame 310 and the case 240 may be formed of a material having excellent durability and a small heat transfer coefficient. In detail, the supporting frame 310 and the case 240 may include at least one material of steel and SUS. Otherwise, the supporting frame 310 and the case 240 may include at least one material of PC, PS, and PPS. In other words, the supporting frame 310 and the case 240 may include at least one material of metal and plastic. However, the materials of the supporting frame 310 and the case 240 are not limited to the same but may differ from each other.

The frame unit 300 may have at least one coupling surface 320 coupled with at least one of the inner casing 11 and the outer casing 12.

The at least one coupling surface 320 may be formed on the case 240. In detail, the at least one coupling surface 320 may be formed on a surface of the case 240.

The at least one coupling surface 320 may include a first coupling surface 321 and a second coupling surface 322.

The first coupling surface 321 may be formed on one surface of the case 240 to face an inner wall of the outer casing 12. The second coupling surface 322 may be formed on another surface of the case 240 to face an outer wall of the inner casing 11.

The case 240 may be inserted into and coupled with at least one of the inner casing 11 and the outer casing 12. For example, the case 240 may include a plurality of protrusions (not shown) which protrude toward at least one of the inner casing 11 and the outer casing 12. The at least one of the inner casing 11 and the outer casing 12 may include a plurality of fixing grooves (not shown) to which the plurality of protrusions formed on the case 240 are able to be inserted and coupled. Preferably, the plurality of protrusions may be formed on the at least one coupling surface 320 which faces the at least one of the inner casing 11 and the outer casing 12. The case 240 may be coupled with the at least one of the inner casing 11 and the outer casing 12 by coupling between the plurality of protrusions and the plurality of fixing grooves.

The case 240 may be fixed to the at least one of the inner casing 11 and the outer casing 12 by the adhesive member 500. Preferably, the at least one coupling surface 320 may be fixed to the at least one of the inner casing 11 and the outer casing 12 by the adhesive member 500. To conclude, the at least one coupling surface 320 may be fixed to the at least one of the inner casing 11 and the outer casing 12 by the adhesive member 500, thereby coupling the case 240 with the body 10.

Members having an adhesive force may be commonly called the adhesive member 500. The adhesive member 500 may include a double-sided tape, but is not limited thereto.

Figure 9:
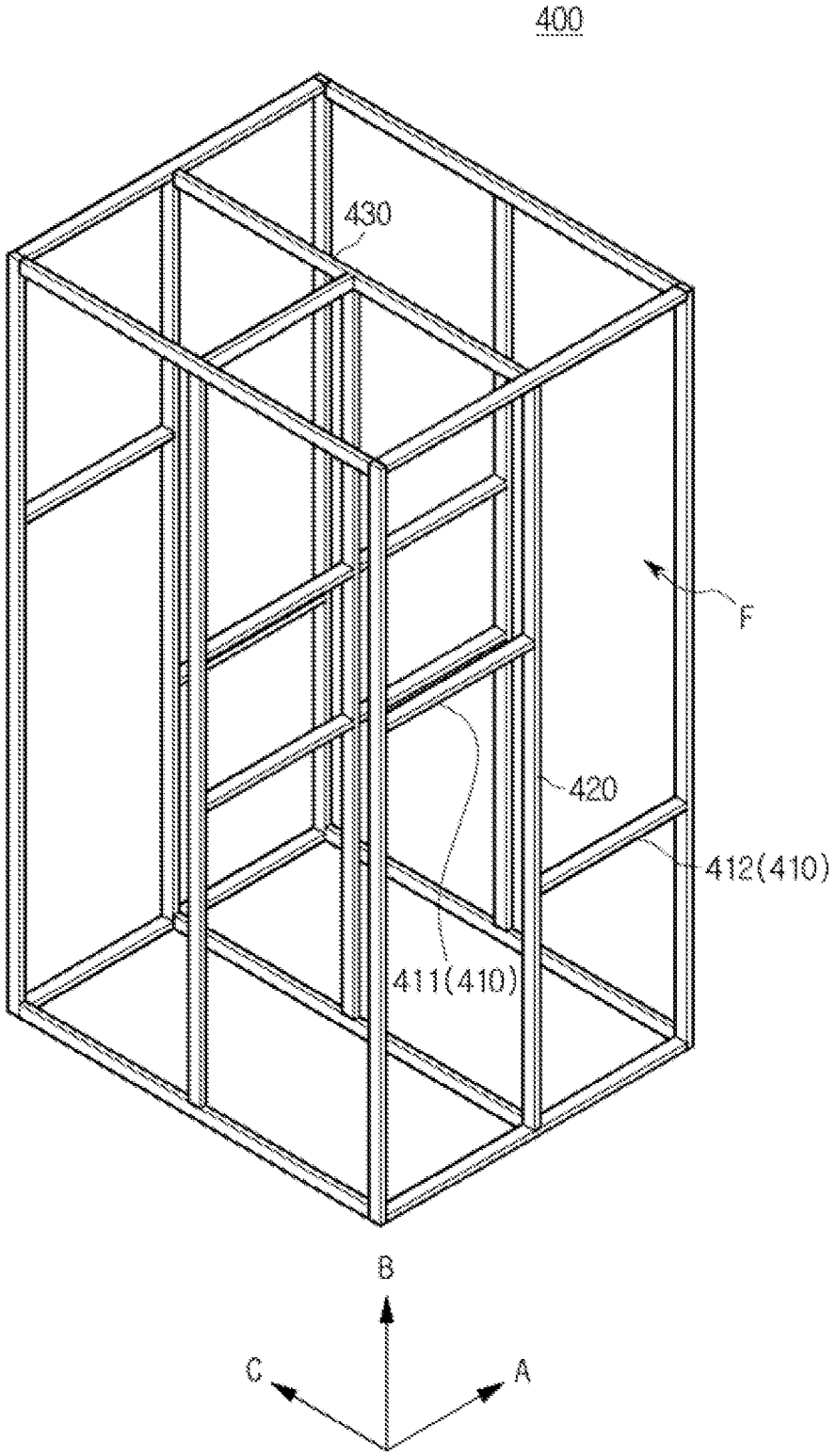
FIG. 9 is a perspective view of a reinforcing member of an insulating unit in accordance with a third embodiment disposed between the inner casing and the outer casing in the refrigerator in accordance with one embodiment of the present invention.
Figure 10:
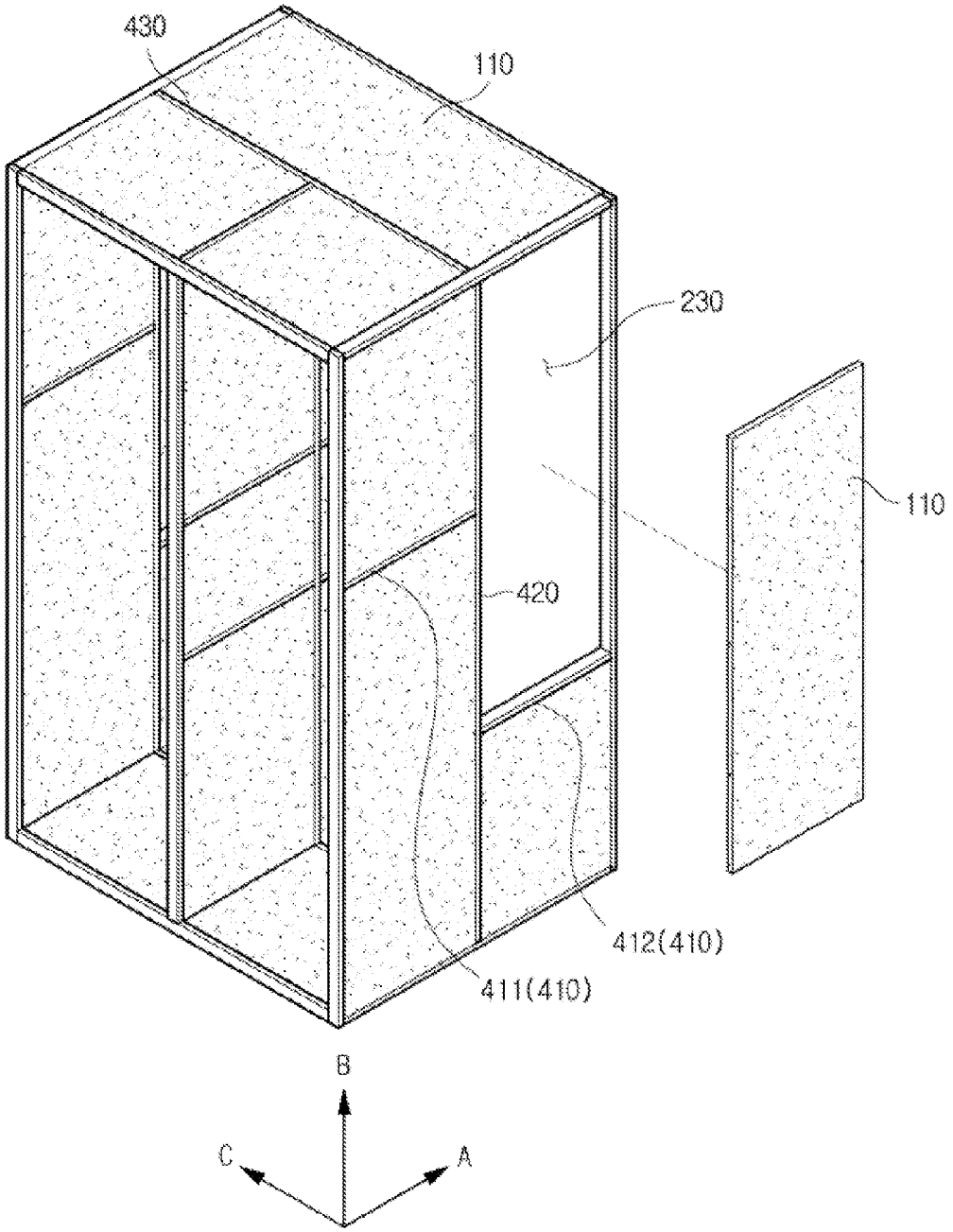
FIG. 10 is an exploded perspective view of the insulating unit in accordance with the third embodiment in the refrigerator in accordance with one embodiment of the present invention.

FIG. 9 is a perspective view of a reinforcing member 400 of the insulating unit 100 in accordance with a third embodiment disposed between the inner casing 11 and the outer casing 12 in the refrigerator 1 in accordance with one embodiment of the present invention. FIG. 10 is an exploded perspective view of the insulating unit 100 in accordance with the third embodiment in the refrigerator 1 in accordance with one embodiment of the present invention. Hereinafter, FIGS. 1 and 2 should be referred to while describing reference numerals not shown in the drawings. The frame units 200 and 300 may be used as means which include the reinforcing member 400.

As shown in FIGS. 9 and 10, the refrigerator 1 may further include the reinforcing member 400 which is provided between the inner casing 11 and the outer casing 12 to ensure stiffness of the body 10 and includes various sized installation spaces 230 in which the insulators 110 are installed.

The reinforcing member 400 may be disposed between the inner casing 11 and the outer casing 12 to be vertical to the inner casing 11 and the outer casing 12.

The reinforcing member 400 may include a first frame 410 which faces a first direction A, a second frame 420 which faces a second direction B, and a third frame 430 which faces a third direction C.

The first frame 410, the second frame 420, and the third frame 430 may be coupled with one another to surround the inner casing 11. In detail, the first frame 410, the second frame 420, and the third frame 430 may be coupled with one another to surround the outer walls of the inner casing 11.

Any one of the first frame 410, the second frame 420, and the third frame 430 may be vertical to another.

The installation space 230 may be formed by a coupling between the one of the first frame 410, the second frame 420, and the third frame 430 and the other.

The reinforcing member 400 may have a grid structure. In detail, the reinforcing member 400 may have an irregular grid structure. To describe another aspect, the reinforcing member 400 may form the installation spaces 230 having various sizes. That is, the installation spaces 230 having various sizes may be formed by a coupling between one of the first frame 410, the second frame 420, and the third frame 430 and another one of the first frame 410, the second frame 420, and the third frame 430. For example, to describe based on one surface F of the reinforcing member 400, a plurality of such second frames 420 which are elongated in the second direction B may be arranged while being spaced apart from one another. A plurality of such first frames 410 which are elongated in the first direction A may be arranged between the plurality of second frames 420 which are arranged while being spaced apart one another. The plurality of first frames 410 may not be arranged in a straight line in the first direction A. In other words, the plurality of first frames 410 may be arranged to be deviated in the first direction A. That is, a front frame 411 located in front of the plurality of first frames 410 and a rear frame 412 located in the rear of the plurality of first frames 410 may be disposed vertically in the second direction B. The installation spaces 230 having various sizes may be formed through a combination of the plurality of first frames 410 and the plurality of second frames 420 which have arrangement structures described above.

The reinforcing member 400 may be formed of a material having excellent durability and a small heat transfer coefficient. In detail, the reinforcing member 400 may include at least one of steel and SUS. Also, the reinforcing member 400 may include at least one material of PC, PS, and PPS. In other words, the reinforcing member 400 may include at least one material of metal and plastic.

The reinforcing member 400 may be directly coupled with the inner casing 11 and the outer casing 12. The reinforcing member 400 may be inserted into and coupled with the inner casing 11 and the outer casing 12. In detail, the inner casing 11 and the outer casing 12 may include a plurality of fixing grooves (not shown). At least one of the first frame 410, the second frame 420, and the third frame 430 may be inserted into and coupled with the plurality of fixing grooves. To conclude, the reinforcing member 400 may be coupled with the inner casing 11 and the outer casing 12 due to coupling between the at least one of the first frame 410, the second frame 420, and the third frame 430 and the plurality of fixing grooves.

Figure 11A:
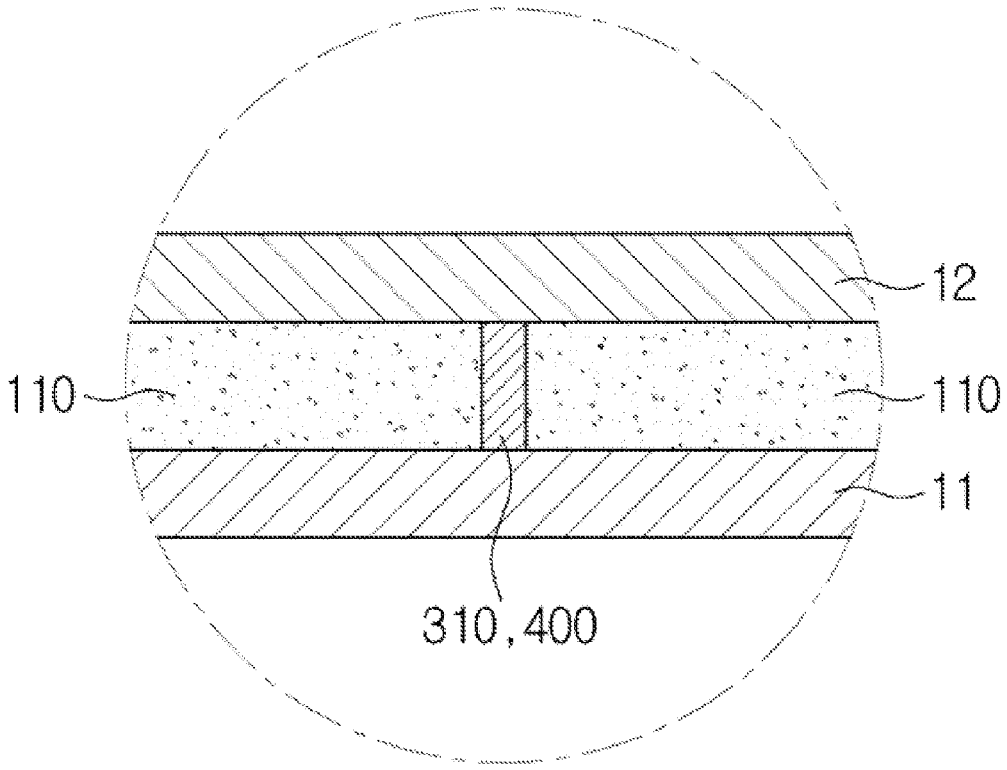
FIGS. 11A to 11C are various cross-sectional views of an insulating unit of the refrigerator in accordance with one embodiment of the present invention.
Figure 11B:
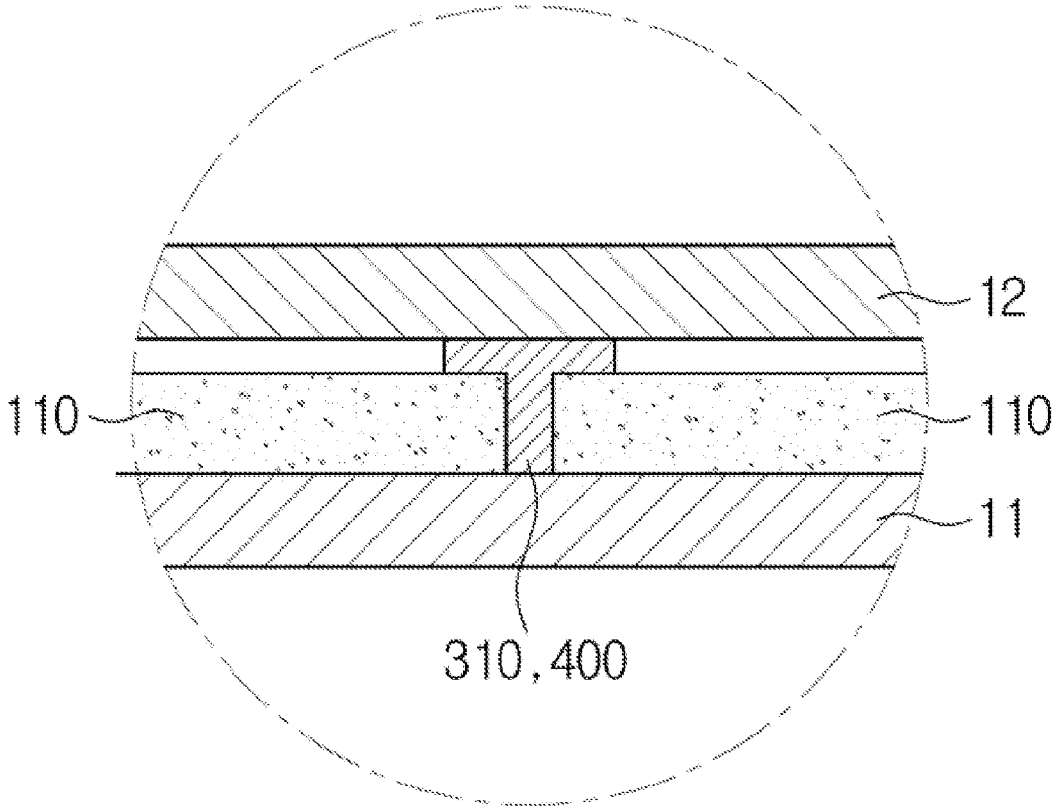
Figure 11C:
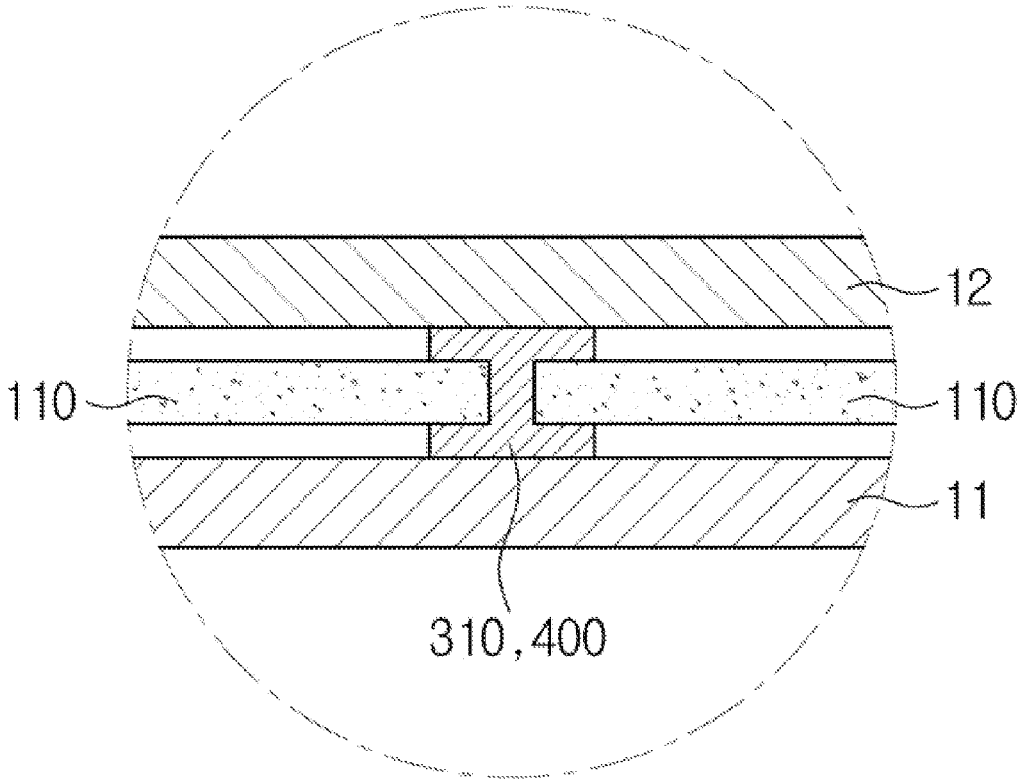

FIGS. 11A to 11C are various cross-sectional views of the insulating unit 100 of the refrigerator 1 in accordance with one embodiment of the present invention. Hereinafter, FIGS. 1 and 2 should be referred to while describing reference numerals not shown in the drawings.

As shown in FIGS. 11A to 11C, the supporting frame 310 or the reinforcing member 400 may have a cross section of various shapes to ensure ease of combination with the at least one of the inner casing 11 and the outer casing. For example, the supporting frame 310 or the reinforcing member 400 may have an I-shape (refer to FIG. 11A), a T-shape (refer to FIG. 11B), or an H-shape (refer to FIG. 11C), but is not limited thereto.

When the supporting frame 310 or the reinforcing member 400 is disposed between the inner casing 11 and the outer casing 12 of the body 10, an area or volume between the inner casing 11 and the outer casing 12 of the body 10 available for the insulator 110 is reduced. When the area or volume between the inner casing 11 and the outer casing 12 of the body 10 is reduced, insulating properties of the refrigerator 1 may be deteriorated. Accordingly, the supporting frame 310 or the reinforcing member 400 may be designed to have a small area or volume within a range without structural bending or distortion.

The frame units 200 and 300 described above may be applied not only to the refrigerator 1 in which a vacuum insulator is used but also to a refrigerator in which a general foam insulator is used and a refrigerator in which the general foam insulator and the vacuum insulator are used together.

As is apparent from the above description, insulating properties of a refrigerator may be improved by installing only a vacuum insulator between an inner casing and an outer casing of a body.

An effect of increasing a storage capacity of a storage compartment may be expected by installing only a vacuum insulator having a relatively small volume between an inner casing and an outer casing.

An insulator may be prevented from being damaged by an external shock or friction by installing a frame unit and a reinforcing member.

A body may be prevented from being deformed or damaged due to a load applied to a refrigerator by installing a frame unit and a reinforcing member.

An insulator may be easily exchanged by a frame unit and a reinforcing member fixed to at least one of an inner casing and an outer casing of a body.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a body comprising an inner casing and an outer casing;

a storage compartment formed in the inner casing;

insulators provided between the inner casing and the outer casing to insulate the storage compartment; and a frame unit which is disposed between the insulators to ensure stiffness of the body and comprises at least one coupling surface coupled with at least one of the inner casing and the outer casing, wherein the frame unit comprises a first frame which faces a first direction and a second frame which faces a second direction, both of which are arranged in a grid shape, and comprises a supporting frame which comprises an installation space in which the insulators are installed and is mounted between the first frame and the second frame, wherein the at least one coupling surface is coupled with the supporting frame to form the installation space, wherein the at least one coupling surface comprises:

a first coupling surface coupled with the supporting frame to face an inner wall of the outer casing; and a second coupling surface coupled with the supporting frame to face an outer wall of the inner casing, wherein the first coupling surface and the second coupling surface are alternately arranged in at least one of the first direction and the second direction.

2. The refrigerator of claim 1, wherein the first coupling surface is located between the insulators and the outer casing, and wherein the second coupling surface is located between the insulators and the inner casing.

3. The refrigerator of claim 1, wherein the at least one coupling surface is fixed to at least one of the inner casing and the outer casing by an adhesive member.

4. The refrigerator of claim 1, wherein the supporting frame is disposed between the inner casing and the outer casing to be vertical to at least one of the inner casing and the outer casing.

5. A refrigerator comprising:

a body comprising an inner casing and an outer casing;

a storage compartment formed in the inner casing;

a vacuum insulator provided between the inner casing and the outer casing to insulate the storage compartment; and a supporting frame which is provided between the inner casing and the outer casing and comprises an installation space in which the vacuum insulator is installed, wherein the installation space comprises at least one side which is open to allow the vacuum insulator to face at least one of the inner casing and the outer casing, wherein the supporting frame comprises:

at least one first frame which is elongated in a first direction; and at least one second frame which is elongated in a second direction to form an intersection point with the at least one first frame; and at least one coupling surface coupled with the at least one first frame and the at least one second frame to form the installation space, wherein the at least one coupling surface is irregularly arranged in at least one of the first direction and the second direction.

6. The refrigerator of claim 5, wherein the at least one first frame and the at least one second frame intersect each other at a right angle.

7. The refrigerator of claim 5, wherein the open side of the installation space is surrounded by the at least one coupling surface.

8. The refrigerator of claim 5, wherein the at least one coupling surface comprises:

a first coupling surface located between the vacuum insulator and the outer casing; and a second coupling surface located between the vacuum insulator and the inner casing.

9. The refrigerator of claim 8, wherein the first coupling surface and the second coupling surface are alternately arranged in at least one of the first direction and the second direction.

10. The refrigerator of claim 8, wherein the installation space comprises:

a first installation space which has one surface open toward the first coupling surface and an outer wall of the inner casing; and a second installation space which has one surface open toward the second coupling surface and an inner wall of the outer casing.

11. The refrigerator of claim 10, wherein the first installation space and the second installation space are alternately arranged in at least one of the first direction and the second direction.

12. The refrigerator of claim 5, wherein the at least one first frame, the at least one second frame, and the at least one coupling surface are integrally formed.

13. The refrigerator of claim 5, wherein the supporting frame is coupled with the body by fixing the at least one coupling surface to at least one of the inner casing and the outer casing by an adhesive member.

14. The refrigerator of claim 5, wherein the supporting frame is inserted into and coupled with at least one of the inner casing and the outer casing.

15. A refrigerator comprising:

a body comprising an inner casing and an outer casing;

a storage compartment formed in the inner casing;

a vacuum insulator provided between the inner casing and the outer casing to insulate the storage compartment; and a reinforcing member which is provided between the inner casing and the outer casing to ensure stiffness of the body, comprises an installation space in which the vacuum insulator is installed and comprises a plurality of surfaces, wherein the reinforcing member comprises:

a first frame which faces a first direction;

a second frame which faces a second direction; and a third frame which faces a third direction, and wherein at least one of the plurality of surfaces of the reinforcing member has an irregular grid structure formed by a coupling between one of the first frame, the second frame and the third frame and another one of the first frame, the second frame and the third frame so as to define various sized installation spaces.

16. The refrigerator of claim 15, wherein the first frame, the second frame, and the third frame are coupled with one another to surround to the inner casing.

17. The refrigerator of claim 16, wherein any one of the first frame, the second frame, and the third frame is vertical to another one of the first frame, the second frame, and the third frame.

18. The refrigerator of claim 15, wherein the reinforcing member is inserted into and coupled with the inner casing and the outer casing.

19. The refrigerator of claim 15, wherein the reinforcing member is directly coupled with the inner casing and the outer casing.

* * * * *